US011812533B2

(12) United States Patent
Chrane et al.

(10) Patent No.: US 11,812,533 B2
(45) Date of Patent: Nov. 7, 2023

(54) SYNCHRONIZED LIGHTING WITH TOGGLE SYSTEM

(71) Applicant: GMI Holdings, Inc., Mt. Hope, OH (US)

(72) Inventors: Jerry B. Chrane, Argyle, TX (US); Donald Y. Perkins, Jr., Richardson, TX (US)

(73) Assignee: GMI Holdings, Inc., Mount Hope, OH (US)

( * ) Notice: Subject to any disclaimer, the term of this patent is extended or adjusted under 35 U.S.C. 154(b) by 85 days.

(21) Appl. No.: 17/342,325

(22) Filed: Jun. 8, 2021

(65) Prior Publication Data

US 2022/0394836 A1 Dec. 8, 2022

(51) Int. Cl.

| | |
|---|---|
| ***E05F 15/77*** | (2015.01) |
| ***H05B 47/17*** | (2020.01) |
| ***H05B 47/155*** | (2020.01) |

(52) U.S. Cl.

CPC ..... *H05B 47/17* (2020.01); *H05B 47/155* (2020.01)

(58) Field of Classification Search

CPC ..... H05B 47/00; H05B 47/10; H05B 47/105; H05B 47/155; H05B 47/17; H05B 47/175; E05F 15/00; E05F 15/77; G07C 9/10; G07C 9/00182; G07C 2009/00928

See application file for complete search history.

(56) References Cited

U.S. PATENT DOCUMENTS

| | | | | |
|---|---|---|---|---|
| 5,969,637 | A * | 10/1999 | Doppelt | H05B 47/16 49/27 |
| 6,737,968 | B1 | 5/2004 | Ergun et al. | |
| 6,975,203 | B2 | 12/2005 | Brookbank et al. | |
| 6,982,652 | B2 | 1/2006 | Laird et al. | |
| 7,161,319 | B2 | 1/2007 | Ergun et al. | |
| 7,262,572 | B2 | 8/2007 | Fitzgibbon | |
| 7,265,508 | B1 | 9/2007 | Karasek et al. | |
| 7,378,760 | B2 | 5/2008 | Olmsted | |
| 8,279,040 | B2 * | 10/2012 | Laird | E05F 15/70 340/5.71 |
| 8,674,625 | B2 | 3/2014 | So | |
| 8,711,131 | B2 | 4/2014 | Kwag et al. | |
| 9,167,669 | B2 | 10/2015 | Karc et al. | |
| 9,286,604 | B2 | 3/2016 | Aabye et al. | |
| 9,699,871 | B2 | 7/2017 | Karc et al. | |
| 9,832,843 | B1 * | 11/2017 | Porter | E06B 7/28 |
| 10,143,069 | B2 | 11/2018 | Cheung et al. | |
| 10,143,071 | B2 | 11/2018 | Karc et al. | |

(Continued)

*Primary Examiner* — Thai Pham

(74) *Attorney, Agent, or Firm* — HAYNES AND BOONE, LLP

(57) ABSTRACT

A light system for a barrier operator includes a plurality of barrier operators each in communication with a respective wall console. The light system further includes a plurality of light kits, each light kit of the plurality of light kits being in communication with at least one barrier operator of the plurality of barrier operators. Each barrier operator of the plurality of barrier operators is configured to select one of the light kits of the plurality of light kits as a master light kit, receive a state information from the master light kit, and transmit the state information of the master light kit to other light kits of the plurality of light kits. As such the lights connected to a barrier operator may become synchronized.

20 Claims, 5 Drawing Sheets

(56) References Cited

U.S. PATENT DOCUMENTS

| | | | | |
|---|---|---|---|---|
| 10,285,238 | B2 | 5/2019 | Chen et al. | |
| 10,342,103 | B2 | 7/2019 | Newman, Jr. et al. | |
| 10,375,805 | B2 | 8/2019 | De Jong et al. | |
| 10,395,865 | B2 | 8/2019 | Scruggs | |
| 10,420,194 | B2 | 9/2019 | Mann et al. | |
| 10,433,402 | B2 | 10/2019 | Chang | |
| 10,435,936 | B2 | 10/2019 | Lietz et al. | |
| 10,624,184 | B2 | 4/2020 | Newman, Jr. et al. | |
| 10,694,610 | B2 | 6/2020 | Karc et al. | |
| 10,694,613 | B2 | 6/2020 | Mann et al. | |
| 10,767,905 | B2 | 9/2020 | Nishijima et al. | |
| 10,806,010 | B2 | 10/2020 | Karc et al. | |
| 2003/0227370 | A1* | 12/2003 | Brookbank | G07C 9/00182 340/5.7 |
| 2004/0217860 | A1 | 11/2004 | Ergun et al. | |
| 2005/0184854 | A1* | 8/2005 | Mullet | G07C 9/00182 340/5.7 |
| 2007/0035382 | A1 | 2/2007 | Lee et al. | |
| 2013/0038218 | A1 | 2/2013 | Xu et al. | |
| 2015/0189721 | A1 | 7/2015 | Karc et al. | |
| 2017/0295630 | A1 | 10/2017 | Lark, Jr. et al. | |
| 2018/0188018 | A1* | 7/2018 | Brown | G01B 11/14 |
| 2019/0132055 | A1* | 5/2019 | Deixler | H04B 10/116 |
| 2019/0182935 | A1 | 6/2019 | Lark, Jr. et al. | |
| 2019/0243539 | A1 | 8/2019 | Cheung et al. | |
| 2019/0348235 | A1 | 11/2019 | Scruggs | |
| 2019/0372802 | A1 | 12/2019 | Slupik et al. | |
| 2020/0007355 | A1 | 1/2020 | Bruneau et al. | |
| 2020/0205274 | A1 | 6/2020 | Newman, Jr. et al. | |
| 2020/0264235 | A1 | 8/2020 | Zhang et al. | |
| 2020/0340288 | A1* | 10/2020 | Ikeler | E05F 15/77 |

* cited by examiner

SYNCHRONIZED LIGHTING WITH TOGGLE SYSTEM

TECHNICAL FIELD

The present disclosure relates generally to light systems associated with movable barrier opener systems, in particular to synchronizing lights connected to multiple operators.

BACKGROUND

Movable barriers, such as upward-acting sectional or single panel garage doors, residential and commercial rollup doors, and slidable and swingable gates, are used to alternatively allow and restrict entry to building structures and property. These barriers are driven between their respective open and closed positions by motors or other motion-imparting mechanisms, which are themselves controlled by barrier moving units, sometimes referred to as "movable barrier operators," and in the specific case of a door, as "door operators," and in the even more specific case of a garage door, as "garage door operators." Garage door operators are effective to cause the DC or AC motor, and accompanying motor drive assembly, to move the associated garage door, typically between its open and closed positions.

Some garage door operators, such as jackshaft operators, may control a remote light, typically in the garage space. It may be advantageous if the garage door operator controlled more than one light. It is possible that in such a scenario, that the lights would become unsynchronized. Accordingly, it is desirable to have a garage door operator lighting system with more than one light that is able to synchronize lights that may otherwise lose synchronization.

SUMMARY

The foregoing needs are met to a great extent by embodiments in accordance with the present disclosure, wherein, in some aspects, are provided systems and methods for synchronizing lights.

In an example aspect, the present disclosure is directed to a lighting system comprising a barrier operator in communication with a wall console and a plurality of light kits. The barrier operator selects one of the light kits as the master light kit. The barrier operator indicates to all of the light kits associated with it the identity of the master light kit. The master light kit provides the barrier operator with its current state (e.g., on/off). The barrier operator relays the master light kit state to the other light kits, and potentially back to the master light kit itself, which is stored in the light kits. When the barrier operator receives a light toggle command from the wall console, it sends a light toggle command to all of the light kits associated with it. In response, the light kits toggle their lights to the opposite of the stored master state information.

In some aspects, there are a plurality of barrier operators and a plurality of light kits. The light kits may be associated with any one of the barrier operators or may be associated with multiple barrier operators. For example, there may be a group of light kits associated with a single barrier operator, a separate group of light kits associated with a different barrier operator, and a third group of light kits associated with both of the barrier operators. Other configurations are considered including more or less barrier operators and more or less light kits connected in a number of different configurations.

For a light kit associated with multiple barrier operators, a toggle command may come from different barrier operators at different times. Each barrier operator may independently determine which light kit they consider to be the master light kit. As such, a single light kit may be a master light kit for one barrier operator, and not be the master light kit for another barrier operator. Alternatively, a single light kit could be identified as a master light kit for multiple barrier operators. In some aspects, each light kit stores a master light kit identification for each barrier operator with which it is associated.

Accordingly, some aspects of the present disclosure are directed to a light kit for illumination connected with a barrier operator system. The light kit may include an illuminator and may include a control module configured to: receive a communication from a barrier operator identifying a master light state of a master light kit; store the master light state in a memory; receive a command from the barrier operator to toggle a light state; and set the light state to opposite the stored master light state.

Additional aspects of the present disclosure are directed to methods of controlling lighting with a barrier operator. The methods may include receiving, at a light control module on a light kit, a communication from a barrier operator identifying a master light state of a master light kit; storing the master light state in a memory; receiving, at the light control module, a command from the barrier operator to toggle a light state; and setting, via the light control module, the light state to opposite the stored master light state.

Yet additional aspects of the present disclosure include a light system for a barrier operator that may include a plurality of barrier operators each in communication with a respective wall console and also may include a plurality of light kits. Each light kit of the plurality of light kits may be in communication with at least one barrier operator of the plurality of barrier operators. Each barrier operator of the plurality of barrier operators may be configured to: select one of the light kits of the plurality of light kits as a master light kit; receive a state information from the master light kit; transmit the state information of the master light kit to other light kits of the plurality of light kits; and transmit a toggle command to the plurality of light kits. Each light kit of the plurality of light kits may be configured to: set a light state based on the state information of the master light kit in response to receiving the toggle command.

Yet additional aspects are directed to methods of controlling lighting with a barrier operator. The method may include selecting, with a light control module, a light kit as a master light kit; receiving, at the light control module, a state information from the master light kit; communicating, from the light control module, the state information to a plurality of light kits; and transmitting, from the light control module, a toggle command to the plurality of light kits.

Yet additional aspects are directed to a barrier operator light system that may include a barrier operator configured to receive communications from a wall console; and a light kit configured to communicate with the barrier operator. The barrier operator is configured to: receive a state information from the light kit; transmit the state information of the light kit back to the light kit; and transmit a toggle command to the light kit. The light kit may be configured to: in response to receiving the state information transmitted by the barrier operator, storing the state information; and in response to receiving the toggle command transmitted by the barrier operator, setting a light state to a state opposite the stored state information.

It is to be understood that both the foregoing general description and the following drawings and detailed description are exemplary and explanatory in nature and are intended to provide an understanding of the present disclosure without limiting the scope of the present disclosure. In that regard, additional aspects, features, and advantages of the present disclosure will be apparent to one skilled in the art from the following. One or more features of any embodiment or aspect may be combinable with one or more features of other embodiment or aspect.

BRIEF DESCRIPTION OF THE DRAWINGS

The accompanying drawings illustrate implementations of the systems, devices, and methods disclosed herein and together with the description, explain the principles of the present disclosure.

Figure 1:
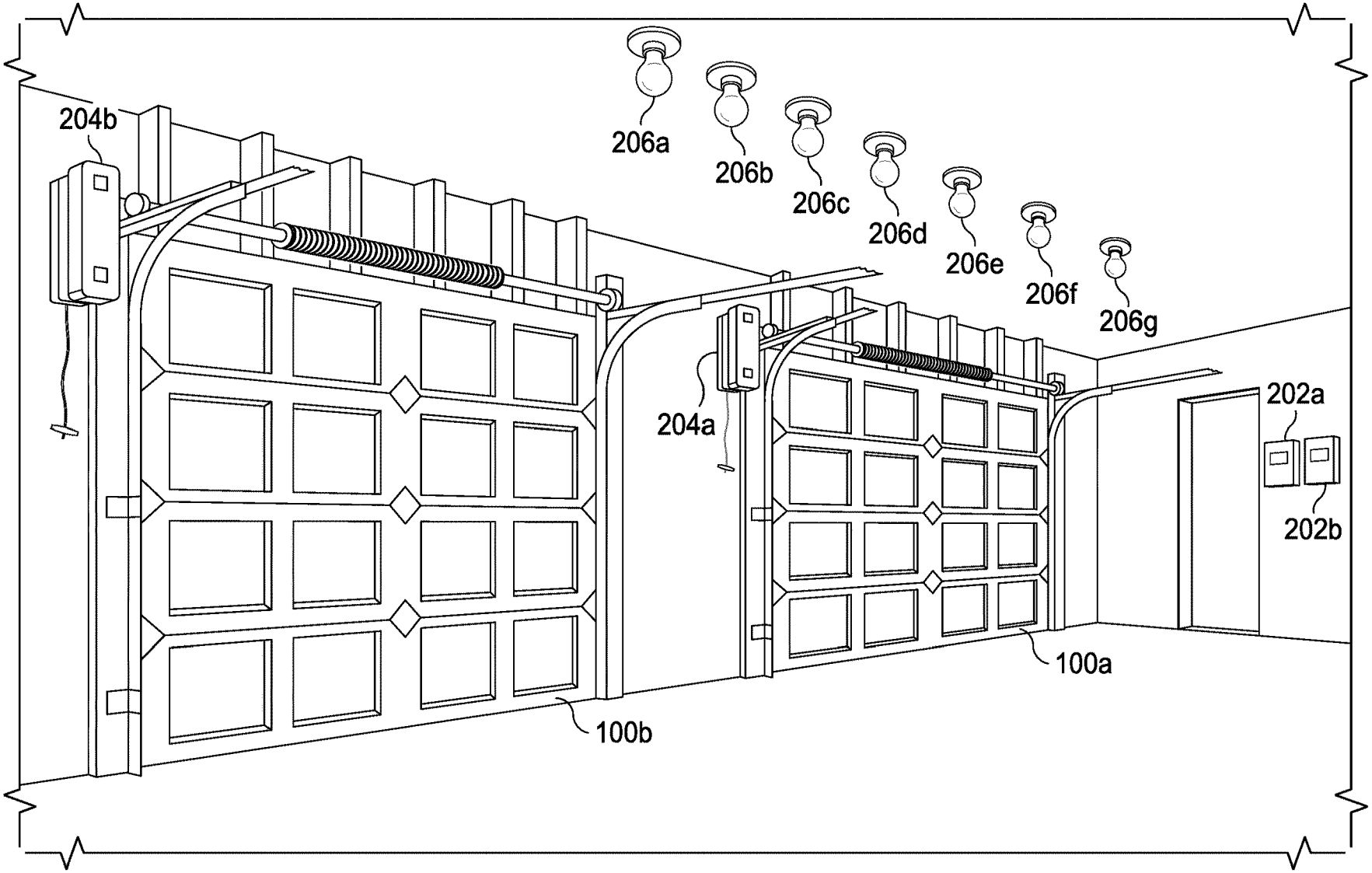
FIG. 1 is a perspective illustration of an example barrier operator lighting system set in a garage environment, according to an example implementation.

These Figures will be better understood by reference to the following Detailed Description.

DETAILED DESCRIPTION

For promoting an understanding of the principles of the present disclosure, reference will now be made to the implementations illustrated in the drawings and specific language will be used to describe them. It will nevertheless be understood that no limitation of the scope of the disclosure is intended. Any further application of the principles of the present disclosure are fully contemplated as would normally occur to one skilled in the art to which the disclosure relates. In addition, this disclosure describes some elements or features in detail with respect to one or more implementations or Figures, when those same elements or features appear in subsequent Figures, without such a high level of detail. It is fully contemplated that the features, components, and/or steps described with respect to one or more implementations or Figures may be combined with the features, components, and/or steps described with respect to other implementations or Figures of the present disclosure. For simplicity, in some instances the same or similar reference numbers are used throughout the drawings to refer to the same or like parts.

FIG. 1 depicts a perspective illustration of the material structural components for an example barrier operator lighting system according to some implementations of the present disclosure. FIG. 1 shows two barrier operators, shown in this example as jackshaft operators 204*a* and 204*b*, light kits 206*a*-206*g*, and wall consoles 202*a* and 202*b*, which in this example implementation are wireless. Each jackshaft operator 204 is configured to control the motion of a garage door 100*a* or 100*b* in response to commands from a corresponding wall console 202. Each of the jackshaft operators 204*a* and 204*b* also connect to one or more light kits 206*a*-206*g*. Which of the jackshaft operators 204*a* and 204*b* connect to which light kits 206*a*-206*g* may be in a number of different combinations as will be described in more detail below.

In some aspects, the light kits 206 may be associated with either of the jackshaft operators 204, or may be associated with both jackshaft operators 204. For example, light kits 206*a*-206*b* may be associated with jackshaft operator 204*a*, light kits 206*f*-206*g* may be associated with jackshaft operator 204*b*, and light kits 206*c*-206*e* may be associated with both of the jackshaft operators 204. Other configurations are considered including more or less barrier operators and more or less light kits connected in a number of different configurations.

For a light kit 206 associated with multiple jackshaft operators 204, a toggle command to change the state of the light from on to off or from off to on may come from different jackshaft operators 204 at different times. The synchronization is carried out based on a current state (i.e., on state or off state) of a master light kit, and a change in state of other connected light kits. Each jackshaft operator 204 may independently determines which light kit 206 it considers to be the master light kit 206. As such, a single light kit 206 may be a master light kit 206 for one jackshaft operator 204, and not be the master light kit 206 for another jackshaft operator 204. Alternatively, a single light kit 206 could be identified as a master light kit 206 for multiple jackshaft operators 204. In some aspects, each light kit 206 stores a master light kit identification and state for each jackshaft operator 204 with which it is associated. In some aspects, messages sent from a jackshaft operator 204 to a light kit 206 include an identification of the jackshaft operator sending the message so that the light kit may behave accordingly. In addition to jackshaft operators 204, aspects of the present disclosure include other types of barrier operators which may be used to control light kits 206.

Each wall console 202 may be associated with a jackshaft operator 204. For example, wall console 202*a* may be used to control jackshaft operator 204*a*, and wall console 202*b* may be used to control jackshaft operator 204*b*. The walls consoles 202*a* and 202*b* may be user interfaces that receive a command from a user to control the jackshaft operators 204*a*, 204*b* and/or the light kits 206*a*-206*f*. In some implementations, the wall consoles 202 may include one or more buttons that may be pushed by a user to initiate a command for the jackshaft operators 204*a*. 204*b* and/or the light kits 206*a*-206*f*. Some wall consoles have a button that generates a toggle signal that causes the light kits to switch from on to off or from off to on. Aspects of the present disclosure may also use other communication components in the place of wall consoles 202. For example, a remote user interface commonly used in a car or designed to be attached to a keyring may permit a user to enter a command to control the barrier operator, the light kits, or both. Additionally, wall consoles 202 may use a wireless connection to jackshaft operators 204 or may use a wired connection.

Figure 2:
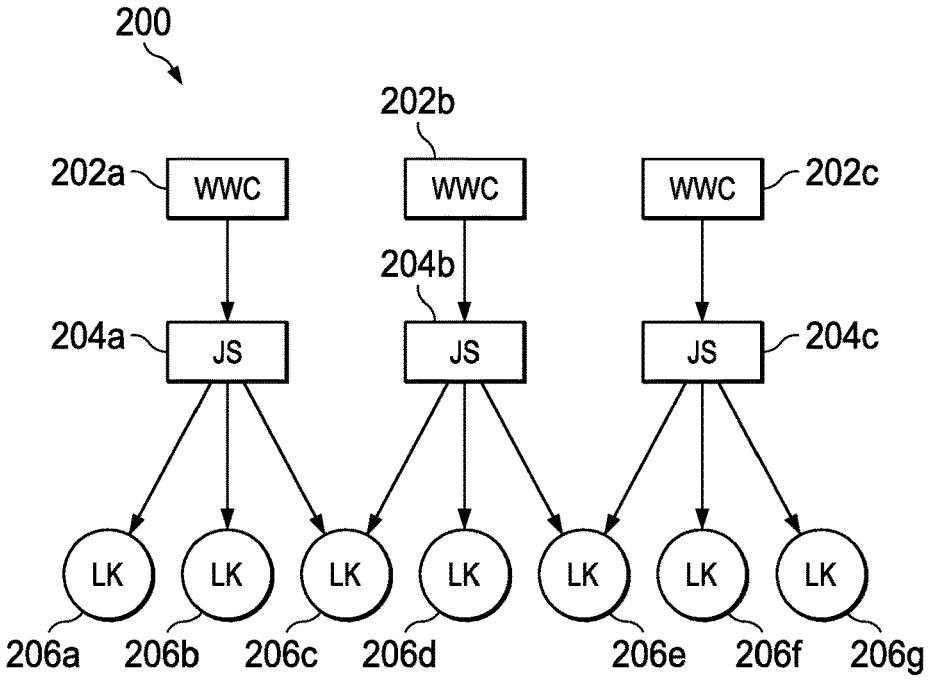
FIG. 2 is a diagram of an example barrier operator lighting system, according to an example implementation.

FIG. 2 illustrates a block diagram of another example lighting system according to some aspects of the present disclosure. The system includes wall consoles 202*a*-202*c*, jackshaft operators 204*a*-204*c*, and light kits 206*a*-206*g*. Aspects of the present disclosure including those discussed with reference to FIGS. 5-7 may be performed using a system such as that illustrated in FIG. 1 or FIG. 2. Many other configurations are possible with different numbers of jackshaft operators, light kits, wall consoles, and different connectivity among them.

The arrows shown in FIG. 2 represent communication, whether wired or wireless, between the components. Wall consoles 202 may communicate with jackshaft operators 204, for instance in order to send a command to toggle the lights. Jackshaft operators 204 may communicate commands and information to light kits 206. Jackshaft operators 204 may also receive information from the light kits 206, for instance information about the current state of the lights (e.g. on/off). As illustrated, two jackshaft operators (or in some cases more) may have a connection with one light kit 206. For instance, jackshaft operators 204*a* and 204*b* may both be in communication with light kit 206*c*. Other light kits 206, however, may only be in communication with a single jackshaft operator 204.

Figure 3:
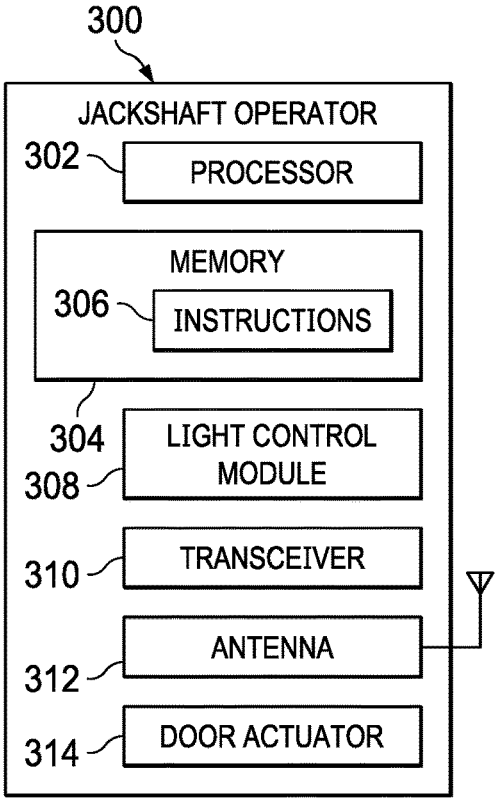
FIG. 3 is a block diagram of a jackshaft operator, according to an example implementation.

FIG. 3 is a block diagram of an example jackshaft operator 300 according to some aspects of the present disclosure. In some instances, the jackshaft operator 300 may be a jackshaft operator 204 as discussed above in FIGS. 1-2. As shown, the jackshaft operator 300 may include a processor 302, a memory 304, a light control module 308, a transceiver 310, one or more antennas 312, and a door actuator 314. These elements may be coupled with one another. The term "coupled" may refer to directly or indirectly coupled or connected to one or more intervening elements. For instance, these elements may be in direct or indirect communication with each other, for example via one or more buses.

The processor 302 may have various features as a specific-type processor. For example, these may include a CPU, a DSP, an ASIC, a controller, a FPGA device, another hardware device, a firmware device, or any combination thereof configured to perform the operations described herein. The processor 302 may also be implemented as a combination of computing devices, e.g., a combination of a DSP and a microprocessor, a plurality of microprocessors, one or more microprocessors in conjunction with a DSP core, or any other such configuration.

The memory 304 may include a cache memory (e.g., a cache memory of the processor 302), RAM, MRAM, ROM, PROM, EPROM. EEPROM, flash memory, other forms of volatile and non-volatile memory, or a combination of different types of memory. In some aspects, the memory 304 may include a non-transitory computer-readable medium. The memory 304 may store instructions 306. The instructions 306 may include instructions that, when executed by the processor 302, cause the processor 302 to perform operations described herein, for example, aspects of FIGS. 1-2 and 5-7. Instructions 306 may also be referred to as program code. The program code may be for causing the jackshaft operator 300 to perform these operations, for example by causing one or more processors (such as processor 302) to control or command the jackshaft operator to do so. The terms "instructions" and "code" should be interpreted broadly to include any type of computer-readable statement(s). For example, the terms "instructions" and "code" may refer to one or more programs, routines, subroutines, functions, procedures, etc. "Instructions" and "code" may include a single computer-readable statement or many computer-readable statements.

The light control module 308 may be implemented via hardware, software, or combinations thereof. For example, the light control module 308 may be implemented as a processor, circuit, and/or instructions 306 stored in the memory 304 and executed by the processor 302. In some implementations, the light control module 308 is includes both the processor 302 and the memory 304.

The light control module 308 may communicate with various components of the jackshaft operator 300 to perform various aspects of the present disclosure, for example, aspects of FIGS. 1-2 and 5-7. In some aspects, the light control module 308 is configured to select one of the connected light kits 206 as a master light kit 206. The light control module 308 of the jackshaft operator 300 may then indicate to each light kit 206 with which it is connected the ID of the master light kit 206. The light control module 308 may then receive from the master light kit 206 an indication of its current state—either on or off. The light control module 308 may then indicate to each of the connected light kits 206, the current state of the master light kit 206. The indication of the master light kit 206 state may be sent to the master light kit 206 itself. At any time that the master light kit 206 changes state (from on to off or from off to on), the light control module 308 may receive updated state information from the master light kit 206. When the jackshaft operator 300 receives a light toggle command from the wall console 202, the jackshaft operator 300 may send a toggle command to each of the connected light kits 206.

At various times, the light control module 308 may select a different light kit 206 to be the master light kit 206. For example, when a new light kit is connected to the jackshaft operator 300, or when a connected light kit 206 is disconnected. Any time a new master light kit 206 is selected from the connected light kits, the light control module 308 communicates the master ID to each connected light kit 206. In response, the selected master light kit sends its current state back to the jackshaft operator 200.

The transceiver 310 can be configured to communicate bi-directionally with other devices, such as the light kits 206. Although described herein as a transceiver, the transceiver comprises a receiver and a transmitter, and some implementations may have distinct receivers and transmitters. The transceiver 310 may be configured to modulate and/or encode data. The transceiver 310 may be configured to process (e.g., perform analog to digital conversion or digital to analog conversion, etc.) modulated/encoded data. The transceiver 310 may use Bluetooth, Bluetooth Low Energy (BLE) or other communications protocols.

The transceiver 310 may provide the modulated and/or processed data, e.g. data packets (or, more generally, data messages that may contain one or more data packets and other information), to the antenna 312 for transmission to one or more other devices. The antenna 312 may further receive data messages transmitted from other devices and provide the received data messages for processing and/or demodulation at the transceiver 310. The transceiver 310 may provide the demodulated and decoded data (e.g., messages indicating reference signals) to the light control module 308 for processing.

The door actuator 314 generates the motion for moving the barrier. In some aspects, the door actuator includes a motor and a drive assembly including chains, belts, pulleys, and an output shaft which moves the garage door. In implementations where the barrier operator is a jackshaft operator, the barrier operator may be mounted on the wall next to the garage door such that the output shaft connects to the torsion shaft of the garage door. In other implementations, the barrier operator may be disposed in the middle of the garage and may connect to the garage door via a track or rail.

Figure 4:
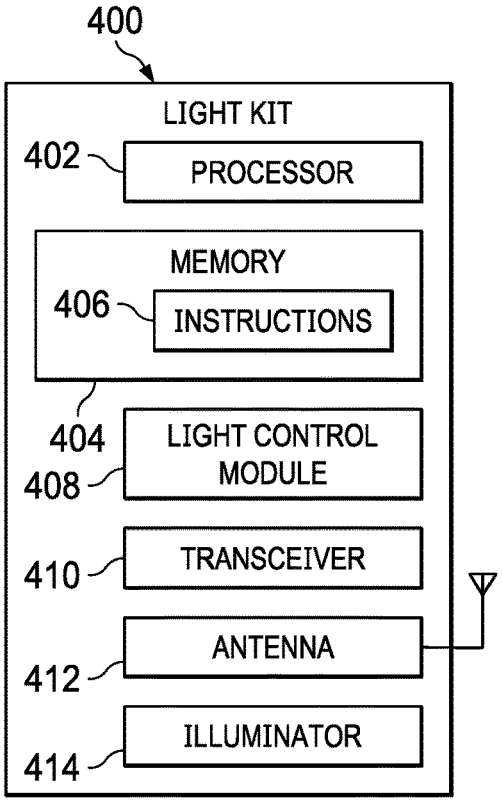
FIG. 4 is a block diagram of a light kit, according to an example implementation.

FIG. 4 is a block diagram of an example light kit 400 according to some aspects of the present disclosure. In some instances, the light kit 400 may be a light kit 206 as discussed above in FIGS. 1-2. As shown, the light kit 400 may include a processor 402, a memory 404, a light control module 408, a transceiver 410, one or more antennas 412, and an illuminator 414. These elements may be coupled with one another. The term "coupled" may refer to directly or indirectly coupled or connected to one or more intervening elements. For instance, these elements may be in direct or indirect communication with each other, for example via one or more buses.

The processor 402 may have various features as a specific-type processor. For example, these may include a CPU, a DSP, an ASIC, a controller, a FPGA device, another hardware device, a firmware device, or any combination thereof configured to perform the operations described herein. The processor 402 may also be implemented as a combination of computing devices, e.g., a combination of a DSP and a microprocessor, a plurality of microprocessors, one or more microprocessors in conjunction with a DSP core, or any other such configuration.

The memory 404 may include a cache memory (e.g., a cache memory of the processor 402), RAM. MRAM. ROM, PROM, EPROM, EEPROM, flash memory, other forms of volatile and non-volatile memory, or a combination of different types of memory. In some aspects, the memory 404 may include a non-transitory computer-readable medium. The memory 404 may store instructions 406. The instructions 406 may include instructions that, when executed by the processor 402, cause the processor 402 to perform operations described herein, for example, aspects of FIGS. 1-2 and 5-7. Instructions 406 may also be referred to as program code. The program code may be for causing the light kit 400 to perform these operations, for example by causing one or more processors (such as processor 302) to control or command the jackshaft operator to do so. The terms "instructions" and "code" should be interpreted broadly to include any type of computer-readable statement (s). For example, the terms "instructions" and "code" may refer to one or more programs, routines, sub-routines, functions, procedures, etc. "Instructions" and "code" may include a single computer-readable statement or many computer-readable statements.

The light control module 408 may be implemented via hardware, software, or combinations thereof. For example, the light control module 408 may be implemented as a processor, circuit, and/or instructions 406 stored in the memory 404 and executed by the processor 402. In some implementations, the light control module 408 is formed of or made up of the processor 402 and the memory 404.

The light control module 408 may communicate with various components of the light kit 400 to perform various aspects of the present disclosure, for example, aspects of FIGS. 1-2 and 5-7. In some aspects, the light control module 408 is configured to receive a master light kit ID from a jackshaft operator 204. This received master light kit ID may be stored in memory 404 and compared to an ID which the light kit 400 uses to identify itself. The light control module 408 may compare the received master light kit ID with its own ID to determine if it was assigned to be the master light kit 400 for the connected jackshaft operator 204. If the IDs match, then the light kit knows it is the master light kit, and it sends the jackshaft operator 204 its current state—either an on state or an off state. Any time the light control module 408 receives a matching ID indicating that it is the master light kit, it may send a message to the jackshaft operator 204 indicating its current state (e.g. light on/off). Additionally, any time the master light control module 408 receives a command to toggle the lights, it sends the jackshaft operator 204 the updated light state after toggling the light.

When the light control module 408 receives, from the jackshaft operator 204, a master ID which does not match its own, then it knows that another light kit 400 is the master for the jackshaft operator 204 which sent the ID. The light kit 400 determines it is not the master by comparing the received ID with its own ID, both of which are stored in memory 404. After receiving the master ID, the light kit 400 may receive, from the jackshaft operator 204, a current light state associated with the master light kit 400 which it may also store in memory 404. As each light kit 400 may be in communication with multiple jackshaft operators 204, each of which may individually select which light kit 400 is the master, the light control module 408 may store in memory 404 a separate master ID and master light state corresponding to each jackshaft operator 204. When receiving a toggle command from a jackshaft operator 204, the light control module 408 takes action based on the master state associated with the jackshaft operator 204 which sent the toggle command.

When a non-master light kit 400 receives a light toggle command from a jackshaft operator 204, the light control module toggles based on the master light kit information. When the non-master light kit 400 receives a toggle command, it sets its state to a state opposite that of the stored master light kit state. For example, if the light kit is on and the stored master light kit state is on, then, in response to a toggle command, the non-master light kit sets its state to off (the state opposite the stored master light kit state) and accordingly turns off illuminator 414. Similarly, if the light kit is off and the stored master light kit state is on, then, in response to a toggle command, the non-master light kit still sets its state to off (the state opposite the stored master light kit state) and accordingly keeps illuminator 414 off. Because the master light kit will also be receiving the same toggle command as the non-master light kit 400, toggling to a state opposite the current state of master light kit results in synchronization with the master. When the non-master light kit 400 receives a toggle command, and the light state is the opposite of the stored master light kit state, then the light control module 408 sets its state to the opposite state of the master light kit, which results in no toggling of the illuminator 414. Again, the non-master light kit 400 assumes the master light kit 400 receives the same toggle command, and by not toggling, it allows the master to toggle and re-synchronize their lights.

The transceiver 410 can be configured to communicate bi-directionally with other devices, such as the jackshaft operators 204. Although described herein as a transceiver, the transceiver comprises a receiver and a transmitter, and some implementations may have distinct receivers and transmitters. The transceiver 410 may be configured to modulate and/or encode data. The transceiver 410 may be configured to process (e.g., perform analog to digital conversion or digital to analog conversion, etc.) modulated/encoded data. The transceiver 410 may use Bluetooth, Bluetooth Low Energy (BLE) or other communications protocols.

The transceiver 410 may provide the modulated and/or processed data, e.g. data packets (or, more generally, data messages that may contain one or more data packets and other information), to the antennas 412 for transmission to one or more other devices. The antennas 412 may further receive data messages transmitted from other devices and provide the received data messages for processing and/or demodulation at the transceiver 410. The transceiver 410 may provide the demodulated and decoded data (e.g., messages indicating reference signals) to the light control module 408 for processing.

Illuminator 414 may be a bulb (whether incandescent. LED, fluorescent, or others) or other light emitting element usable to provide light to the garage.

Figure 5:
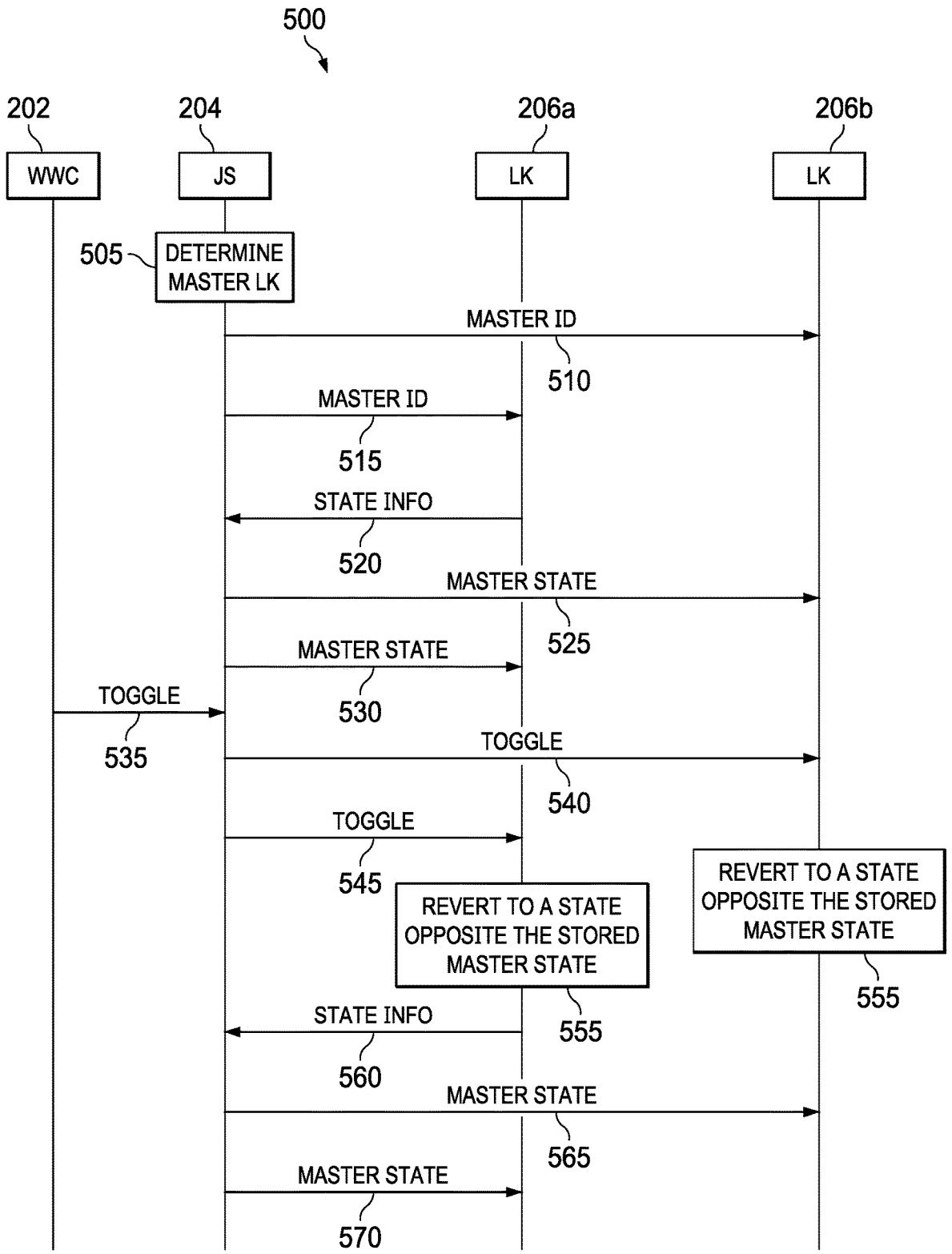
FIG. 5 is a communication diagram of a method according to one example implementation.

FIG. 5 illustrates a sequence diagram 500 for synchronizing lights according to some aspects of the present disclosure. Aspects of the sequence diagram 500 may be performed by barrier operator lighting systems, such as the systems of FIGS. 1-2. In this regard, a jackshaft operator 204 or 300, a wall console 202, and light kits 206 or 400 may perform functions of the sequence diagram 500. For simplicity, sequence diagram 500 illustrates an example aspect where a single jackshaft operator 204 is connected to two light kits 206. However, as discussed with reference to FIGS. 1-4, many other configurations of jackshaft operators 204 and light kits 206 are within the scope of this disclosure. In some aspects, the jackshaft operator 204 may utilize one or more components, such as the processor 302, the memory 304, the light control module 308, the transceiver 310, and the one or more antennas 312 shown in FIG. 3, and the light kits 206 may utilize one or more components, such as the processor 402, the memory 404, the light control module 408, the transceiver 410, the one or more antennas 412, and the illuminator 414 shown in FIG. 4. As illustrated, the sequence diagram 500 includes a number of enumerated actions, but aspects of the FIG. 5 may include additional actions before, after, and in between the enumerated actions. In some aspects, one or more of the enumerated actions may be omitted or performed in a different order.

At action 505, the jackshaft operator 204 selects one of the connected light kits 206 as the master. As illustrated, the light kit 206*a* is selected to be the master. The jackshaft operator 204 may use a variety of methods to select a master, but generally the decision is not important, and can be done in any manner convenient to the jackshaft operator 204.

At action 510, jackshaft operator 204 transmits the master ID to light kit 206*b*, and at action 515, jackshaft operator 204 transmits the master ID to light kit 206*a*. These operations may be performed in any order, and in some aspects may be performed concurrently.

At action 520, the master light kit (in this instance light kit 206*a*) communicates its current state to the jackshaft operator 204. In some aspects, non-master light kits 206 may also communicate their state to the jackshaft operator 204, and the jackshaft operator 204 may ignore these non-master states.

At action 525, jackshaft operator 204 transmits the master state to light kit 206*b*, and at action 530, jackshaft operator 204 transmits the master state to light kit 206*a*. These operations may be performed in any order, and in some aspects may be performed concurrently. Alternatively, the jackshaft operator 204 may not communicate the master state to the master light kit (as illustrated light kit 206*a*). In the case the jackshaft operator 204 does communicate the master state to the master light kit 206, the master light kit 206 may ignore the communication as it may already be aware of its own state.

At action 535, wall console 202 sends a toggle command to jackshaft operator 204. This may be generated at the wall as result of a user input, such as a user pressing a button on the wall console 202.

At action 540, jackshaft operator 204 transmits a toggle command to light kit 206*b*, and at action 545, jackshaft operator 204 transmits a toggle command to all connected light kits. At 540, the jackshaft operator transmits the toggle command to the light kit 206*a*. These operations may be performed in any order, and in some aspects may be performed concurrently.

At action 550, due to the receipt of the toggle command, the light kit 206*b* sets its state to a state opposite the state of the stored master light kit. As illustrated, light kit 206*b* is not the master light kit, so the state that the non-master light kit sets its state to based on comparing its current light state with the stored master light state it received from jackshaft operator 204. If the states are the same, then light kit 206*b* sets its light to the state opposite the stored master light state so that it stays synchronized with the master light kit (here light kit 206*a*) which will also revert to a new state. If the states are different (e.g., the stored master state is on and the non-master state is off), then light kit 206*b* sets its light to the opposite state of the stored master light state, which means that the non-master light state will not change. Thus, the lights will then by synchronized.

At action 555, due to the receipt of the toggle command, the light kit 206*a* sets its state to a state opposite the state of the stored master light kit. As illustrated, light kit 206*a* is the master light kit, so it will toggle its light whenever it receives a toggle command. This only applies when the command comes from the jackshaft operator which has selected the light kit as the master, as there may be other jackshaft operators 204 connected to light kit 206*a* which have not selected it to be the master.

In some implementations, regardless of the current state, the light control modules are configured to switch or sets its state to a state opposite the stored master light state, upon receipt of a toggle command, regardless of the current light state of the light kit. This efficiency eliminates a need to compare states, and the light kits do not consider or take into account their own light state. Rather, each light kit simply acts when it receives a toggle command. If the stored master light state is on, and the light kit's light is on, then the light kit will switch off. If the stored master light state is on, and the light kit's light is off, then the light kit will effectively switch or sets its state to on, resulting in no change to the light state.

At action 560, the master light kit 206*a* transmits its updated state information to jackshaft operator 204. In aspects where light kit 206*a* is connected to multiple jackshaft operators 204, it may transmit its updated state to all of the connected jackshaft operators 204, or only to those for which it is designated as the master. In some aspects, light kit 206*b* may also send its updated state to one or more jackshaft operators 204.

At action 565, jackshaft operator 204 transmits the master state to light kit 206*b*, and at action 570, jackshaft operator 204 transmits the master state to light kit 206*a*. These operations may be performed in any order, and in some aspects may be performed concurrently. Alternatively, in some implementations, the jackshaft operator 204 may not communicate the master state to the master light kit (as illustrated light kit 206*a*). In the case the jackshaft operator 204 does communicate the master state to the master light kit 206, the master light kit 206 may ignore the communication as it may already be aware of its own state.

Figure 6:
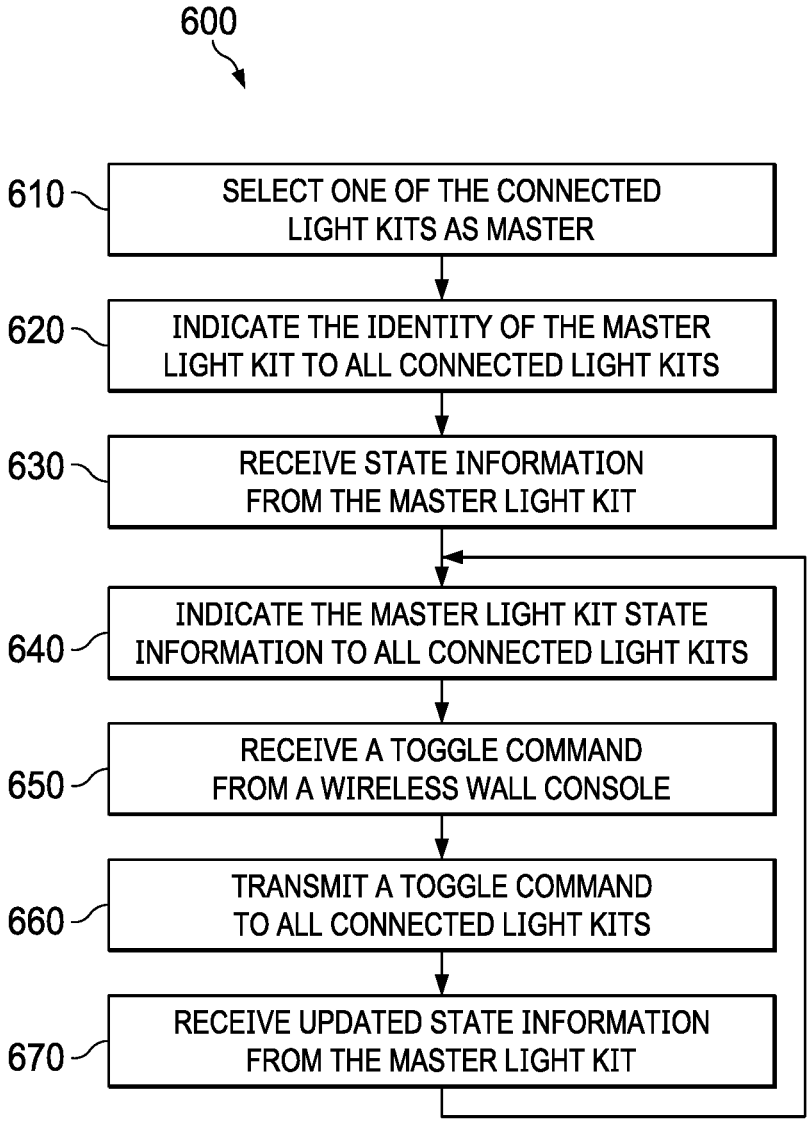
FIG. 6 is a flow chart of a method performed by a barrier operator according to one example implementation.

FIG. 6 is a flow diagram of a light synchronization method 600 according to some aspects of the present disclosure. Aspects of the method 600 can be executed by a barrier operator such as a jackshaft operator 204 or 300 which may utilize one or more components, such as the processor 302, the memory 304, the light control module 308, the transceiver 310, and the one or more antennas 312, to execute the steps of method 600. As illustrated, the method 600 includes a number of enumerated steps, but aspects of the method 600 may include additional steps before, after, and in between the enumerated steps. In some aspects, one or more of the enumerated steps may be omitted or performed in a different order.

At block 610, a jackshaft operator 204 may select one of the light kits connected to which is it connected as a master. The jackshaft operator 204 may use a variety of methods to select a master, but generally the decision is not important, and can be done in any manner convenient to the jackshaft operator 204.

At block 620, the jackshaft operator 204 may indicate the identity of the master light kit 206 to all connected light kits 206. This may or may not include the master light kit 206 itself.

At block 630, the jackshaft operator 204 may receive state information from the master light kit 206. In some aspects, the non-master light kits may also transmit their state, and the jackshaft operator 204 may ignore these.

At block 640, the jackshaft operator 204 may indicate the master light kit state information to all connected light kits. This may or may not include the master light kit 206 itself.

At block 650, the jackshaft operator 204 may receive a toggle command from a wired or wireless wall console 202. In some aspects, the toggle command may come from another source such as a key dongle, a vehicle-based transmitter, or some other remote device.

At block 660, the jackshaft operator 204 may transmit a toggle command to all connected light kits 206. This may be done in response to receiving the toggle command from the wall console 202.

At block 670, the jackshaft operator 204 may receive updated state information from the master light kit. This may occur any time the master light kit changes state, including when another jackshaft operator for which it is not a master sends it a toggle command.

Figure 7:
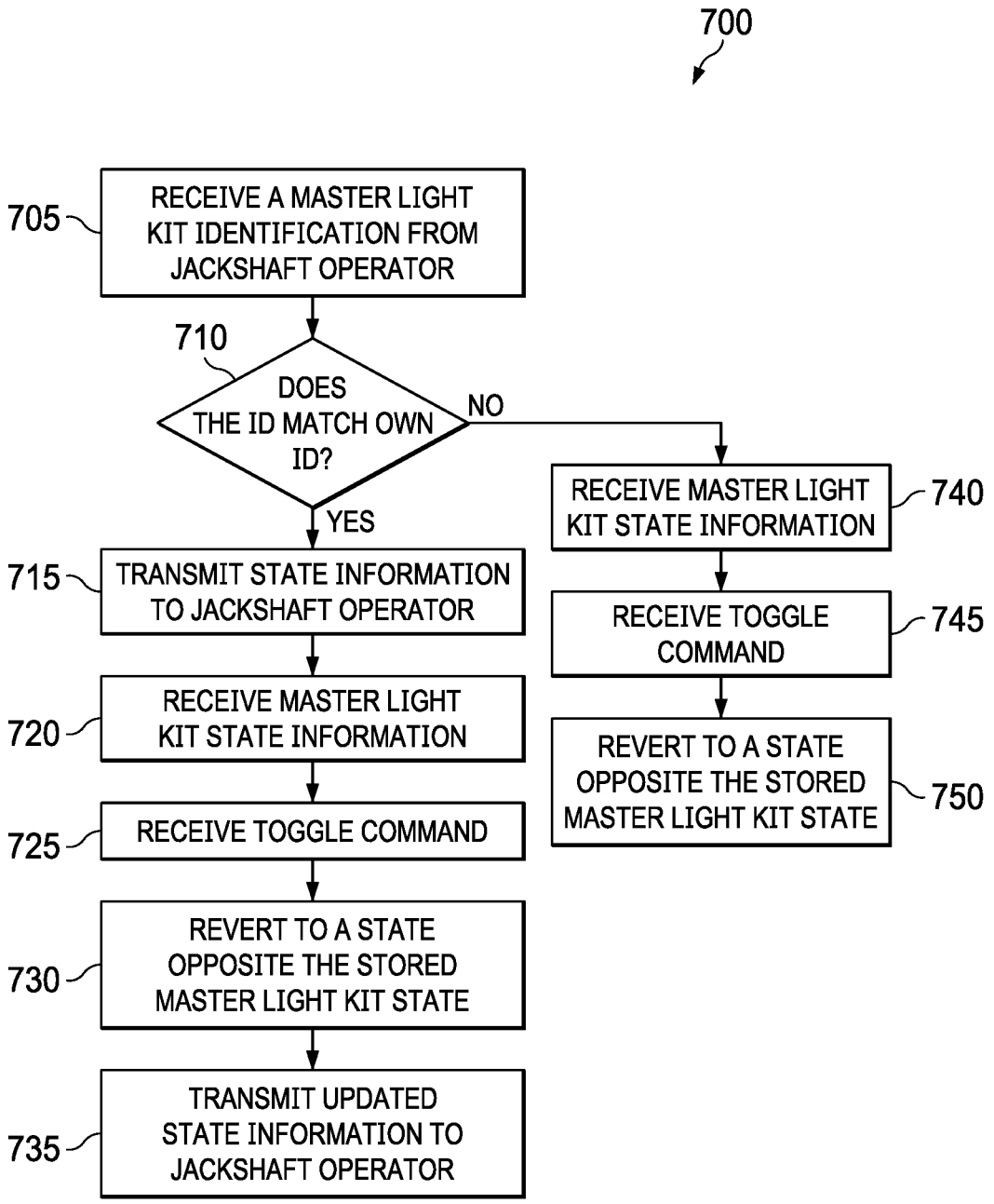
FIG. 7 is a flow chart of a method performed by a light kit according to one example implementation.

FIG. 7 is a flow diagram of a light synchronization method 700 according to some aspects of the present disclosure. Aspects of the method 700 can be executed by a light kit 206 or 400 which may utilize one or more components, such as the processor 402, the memory 404, the light control module 408, the transceiver 410, and the one or more antennas 412, to execute the steps of method 700. As illustrated, the method 700 includes a number of enumerated steps, but aspects of the method 700 may include additional steps before, after, and in between the enumerated steps. In some aspects, one or more of the enumerated steps may be omitted or performed in a different order.

At block 705, a light kit 206 may receive a master light kit identification from a jackshaft operator 204.

At decision block 710, the light kit 206 may determine whether the received master ID matches its own ID. If it does, then it is the master for that jackshaft operator which sent the ID, and the method continues to block 715. If the IDs do not match, then the light kit 206 is not the master for that jackshaft operator which sent the ID and the method continues to block 740.

At block 715, when the light kit 206 is designated as the master, the light kit 206 may transmit its current state information to the jackshaft operator 204. This may be done any time a light kit 206 receives a message indicating that it is the master. It's worth noting that in some implementations, all light kits may transmit their state, but the jackshaft operator 204 may ignore the states of the non-master light kits.

At block 720, the light kit 206 may receive the master light kit state (e.g., on or off) from the jackshaft operator 204. The light kit may store master light kit state in the memory, which may make up a part of the light control module. In some aspects, the light kit 206 may not receive the state back when it is the master light kit.

At block 725, the light kit 206 may receive a toggle command from the jackshaft operator 204. With the transmission of the toggle command there may be some indication of the identity of the jackshaft operator sending the command.

At block 730, the light kit 206 may set the light state to a state opposite the stored state of the master light kit in response to the toggle command. This may occur without comparing the stored master light kit state to the current state of the master light kit as described herein.

At block 735, the light kit 206 may transmit its updated state information to the jackshaft operator 204. Prior to transmitting the updated state information, the light kit 206 may first check that it is the master light kit for the jackshaft operator 204 which sent the toggle command.

At block 740, when the light kit 206 is not designated as the master, the light kit 206 may receive the master light kit state information. The light kit may store the master light kit state in the memory, which may make up a part of the light control module.

At block 745, the light kit 206 may receive a toggle command from the jackshaft operator 204. With the transmission of the toggle command there may be some indication of the identity of the jackshaft operator sending the command.

At block 750, the light kit 206 may toggle or not toggle the light in order to match the master light kit. When the light kit receives the toggle command, the light kit 206 may set the light state to a state opposite the stored state of the master light kit. This may occur without comparing the stored master light kit state to the current state of the light kit as described herein.

By switching or setting to a state opposite the stored master light state and recognizing that the master light kit will also change state, then the light will maintain synchronization with the master.

The steps described in the methods of FIGS. 6-7 are examples. Numerous configurations of wall consoles 202, jackshaft operators 204, and light kits 206 are possible. The generally methods described continue to function in these other contexts such that when a user presses a button on a wall console to toggle the lights, the corresponding light kits associated with the jackshaft operator which is associated with the wall console will become synchronized.

Although some embodiments have been described in detail above, the embodiments described are illustrative only, and those skilled in the art will readily appreciate that many other modifications, changes, and/or substitutions are possible in the embodiments without materially departing from the novel teachings and advantages of the present disclosure. Accordingly, all such modifications, changes, and/or substitutions are intended to be included within the scope of this disclosure as defined in the following claims.

What is claimed is:

1. A light kit for illumination connected with a barrier operator system, comprising:

an illuminator;

a control module configured to:

receive a communication from the barrier operator identifying a light state of a second light kit as a master light state, wherein the master light state is either an on state or an off state;

store the master light state in a memory;

receive a command from the barrier operator to toggle a light state of the light kit; and set the light state of the light kit to opposite the master light state.

2. The light kit of claim 1, wherein the illuminator turns on or off according to the light state of the light kit.

3. The light kit of claim 1, wherein the control module is further configured to receive a master light kit identification (ID).

4. The light kit of claim 3, wherein the control module is further configured to:

transmit the light state of the light kit to the barrier operator in response to receiving the master light kit ID when the master light kit ID matches the light kit's own ID.

5. The light kit of claim 3, wherein the control module is further configured to:

transmit the light state of the light kit to the barrier operator after setting the light state of the light kit when the master light kit ID matches the light kit's own ID.

6. The light kit of claim 3, wherein the master light state is stored in the memory such that it is associated with the barrier operator that transmitted the master light state.

7. The light kit of claim 1, further comprising a transceiver configured to receive the communication from the barrier operator and the command from the barrier operator.

8. The light kit of claim 7, wherein the transceiver is configured to perform an analog to digital conversion on the communication from the barrier operator.

9. The light kit of claim 7, wherein the transceiver is configured to perform an analog to digital conversion on the command from the barrier operator.

10. The light kit of claim 7, wherein the transceiver is configured to provide the communication from the barrier operator and the command from the barrier operator to the control module.

11. A method of controlling lighting with a barrier operator, comprising:

receiving, at a light control module, a communication from the barrier operator identifying a light state of a light kit as a master light state, wherein the master light state is either an on state or an off state;

storing the master light state in a memory;

receiving, at the light control module, a command from the barrier operator to toggle a light state of the light control module; and setting, via the light control module, the light state of the light control module to opposite the stored master light state.

12. The method of claim 11, wherein an illuminator turns on or off according to the light state of the light control module.

13. The method of claim 11, further comprising receiving a master light kit identification (ID).

14. The method of claim 13, further comprising:

transmitting the light state of the light control module to the barrier operator in response to receiving the master light kit ID when the master light kit ID matches the light kit's own ID.

15. The method of claim 13, further comprising:

transmitting the light state of the light control module to the barrier operator after setting the light state of the light control module when the master light kit ID matches the light kit's own ID.

16. The method of claim 13, wherein the master light state is stored in the memory such that it is associated with the barrier operator that transmitted the master light state.

17. The method of claim 11, further comprising:

receiving at a transceiver, the communication from the barrier operator and the command from the barrier operator.

18. The method of claim 17, further comprising:

performing, at the transceiver, an analog to digital conversion on the communication from the barrier operator.

19. The method of claim 17, further comprising:

performing, at the transceiver, an analog to digital conversion on the command from the barrier operator.

20. The method of claim 17, further comprising:

providing, from the transceiver to the control module, the communication from the barrier operator and the command from the barrier operator.

* * * * *